United States Patent [19]

Tuson

[11] 4,119,145

[45] Oct. 10, 1978

[54] COLUMN STRUCTURE ENABLING HANDLING APPLIANCES ON THE SEABED, PARTICULARLY FOR THE ASSEMBLY AND MAINTENANCE OF WELL-HEADS

[75] Inventor: Samuel Tuson, Mesnil le Roi, France

[73] Assignee: Entreprise d'Equipements Mecaniques et Hydrauliques E.M.H., Boulogne, France

[21] Appl. No.: 802,051

[22] Filed: May 31, 1977

[30] Foreign Application Priority Data

Jun. 9, 1976 [FR] France ..... 76 17405

[51] Int. Cl.[2] ..... E21B 7/12

[52] U.S. Cl. ..... 166/339; 175/10; 166/360

[58] Field of Search ..... 166/0.5, 0.6; 175/9, 175/10; 61/110, 72.7

[56] References Cited

U.S. PATENT DOCUMENTS

| | | | |
|---|---|---|---|
| 1,958,041 | 5/1934 | Hansen | 175/10 |
| 3,690,112 | 9/1972 | Pattison et al. | 166/0.6 |
| 3,739,592 | 6/1973 | Plake | 166/0.6 |
| 3,789,921 | 2/1974 | De Chassey et al. | 175/9 |

*Primary Examiner*—Stephen J. Novosad
*Assistant Examiner*—Richard E. Favreau
*Attorney, Agent, or Firm*—Larson, Taylor and Hinds

[57] ABSTRACT

The invention concerns the handling of appliances on the seabed, particularly for handling and maintaining well-heads and corresponding installations. For handling the well-heads, trolleys are mounted for travel along a column which is articulated to a base constructed on the seabed over a number of drilling wells. The trolleys are movable between the upper structure of the columns and the lower body part of the column coupled to the base, and carry well-heads or other devices between the upper structure and the base and release the same upon reaching the lower part of the column at a position above corresponding well orifices. Elongate vertical members or posts of the column have lateral walls constituting guide rails for the trolleys.

7 Claims, 9 Drawing Figures

COLUMN STRUCTURE ENABLING HANDLING APPLIANCES ON THE SEABED, PARTICULARLY FOR THE ASSEMBLY AND MAINTENANCE OF WELL-HEADS

The invention relates to processes for handling appliances on the sea bed, more particularly for the assembly and maintenance of well-heads in oil (gas etc.) installations.

It is recalled first of all that there are known, particularly in said installations, platforms or columns resting on the sea-bed, particularly articulated columns, of the kind described in particular in French Pat. No. 1,519,891 of the present applicant.

The present invention has as its object to adapt these columns to new applications, particularly for servicing and maintaining wells bored in deep water.

It is known that the working of these wells has led to the development of the technique of under-water heads, intended to be placed at the head of said wells, at their outlet on the sea-bed for feeding the oil towards production platforms or columns located at a distance.

These heads require maintenance which, up to now, has been provided from a semisubmersible platform. This solution required fairly complicated equipment for access to said heads from such a platform, which is subject to fairly large movements depending on the meteorological conditions, whereas the well on the sea-bed has a fixed position.

It has been imagined in accordance with the invention to have recourse, for the maintenance and servicing of at least one well-head or — as will be supposed hereafter — of several well-heads located on an underwater base at which end several wells, for example about a central axis, to a platform or column resting on said base, particularly articulated thereto, and equipped with means for guiding, along said column, lifting apparatus of the well-head(s) and all members cooperating therewith.

In particular, according to an advantageous embodiment, said column comprises posts, against certain of the walls of which trolleys can travel or any other means providing a connection between the head or the upper deck of the column and the underwater base in combination with lifting means, for placing the well-heads on the orifices thereof or, generally, to provide for all manoeuvres comprising a to and fro movement between the deck of the column and the sea-bed or requiring guiding.

The presence of this column provides at the same time permanent connections between the platform and the different accessories of the wells or well-heads, particularly the remote control of the valves etc.

Furthermore, because this column is continuously present it enables the existence of well-heads at the base of said column to be physically localized, with respect to sea navigation in the neighbourhood of the installation, so that accidents can thus be prevented, in particular the fouling of these well-heads by trawl nets dragged on the sea-bed.

The invention consists, apart from these dispositions, of certain other arrangements which are preferably used at the same time and which will be explicitly mentioned hereafter.

One of these arrangements consists in passing the remote control cables of the well-heads inside hollow posts of the column.

Means will then be advantageously provided for putting, by means of ropes or similar manoeuvrable from the surface by winches, control cables in position during the installation of the well-heads or for raising them again, for alterations or other operations on said heads, these cables being connected at the surface to appropriate cabinets.

The invention relates more particularly to certain modes of application — particularly that for which it is applied to the service columns for control and maintenance of well-heads — as well as certain embodiments of said arrangements; and it relates more particularly still, and as novel industrial products, to units of the kind in question applying these same arrangements, as well as special elements for their construction.

And it will be, in any case, well understood from the complement of description which follows, as well as from the accompanying drawings, this complement and drawings being of course given solely as an indication.

FIG. 1 of these drawings shows schematically in elevation the upper part of a service column, for oil wells, constructed in accordance with the invention.

Figure 1:
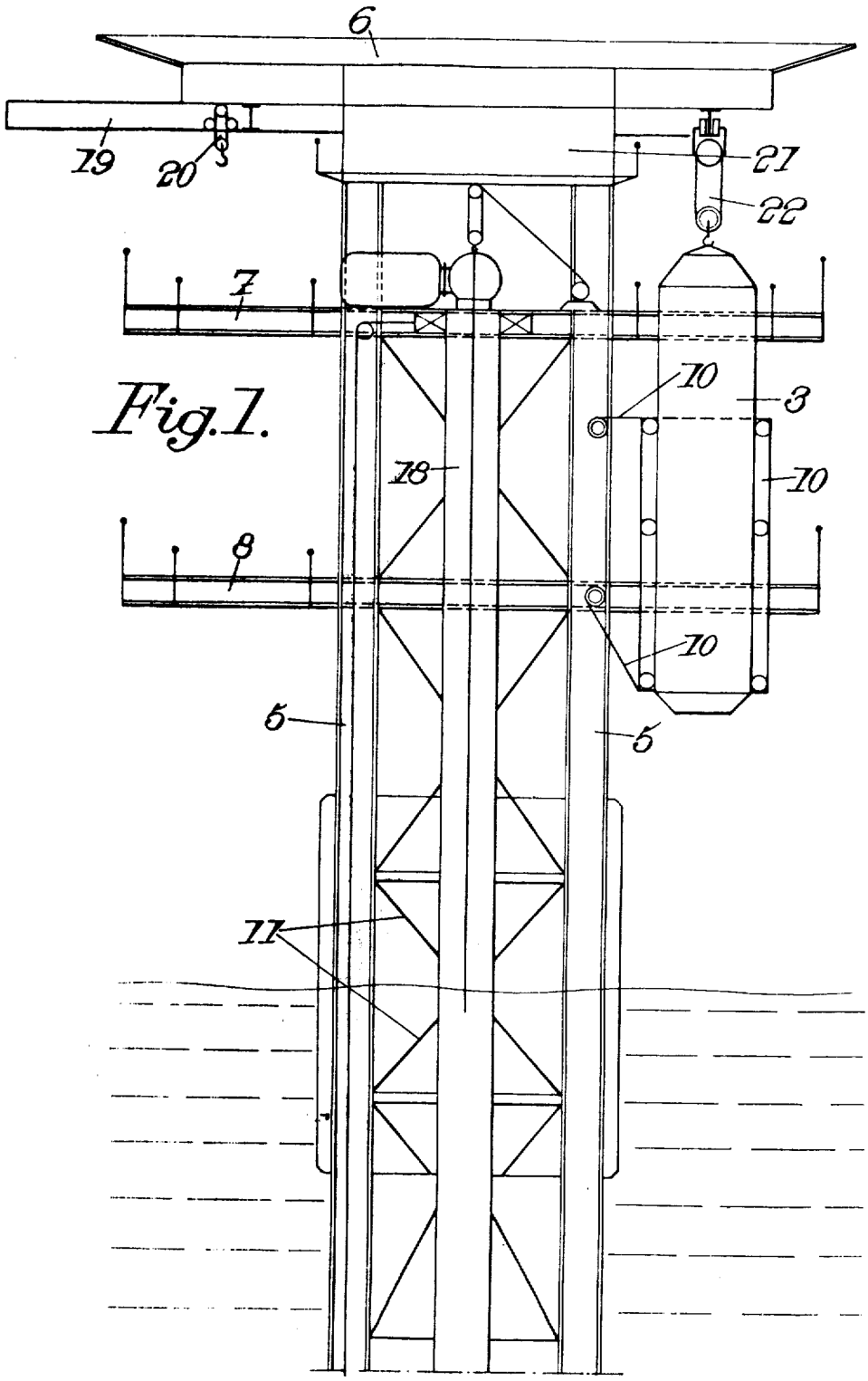

According to the invention, and more specially according to that of its modes of application and those of the embodiments of its different parts to which it seems preference should be given, with for example several oil-wells 1 flush on a base 2 resting on the sea-bed, for example disposed about a central axis, (FIG. 2) in order to provide the remote control and the maintenance of these wells, particularly by means of well-heads 3 of a conventional type introduced and anchored in the openings 4 of said wells, the following or similar is the procedure to adopt.

Recourse is had to a hinged column, i.e. a column formed essentially from vertical members or posts such as 5, finishing at the upper part in a superstructure having one or more floors such as 6, 7, 8, said column being connected to base 2 by its lower part by means of a universal or gimbal joint 9 (FIGS. 1 & 2), and this column is arranged so as to serve as a mechanical guide for trolleys or other appliances of this kind 10 capable of moving well-heads between the upper structure 6, 7, 8 and base 2 for their assembly, on the one hand, or their disassembly for maintenance or repair, on the other.

Said column can moreover serve as a guide for all other handling equipment, or tools or electrical, mechanical or hydraulic contactors etc.

Figure 3:
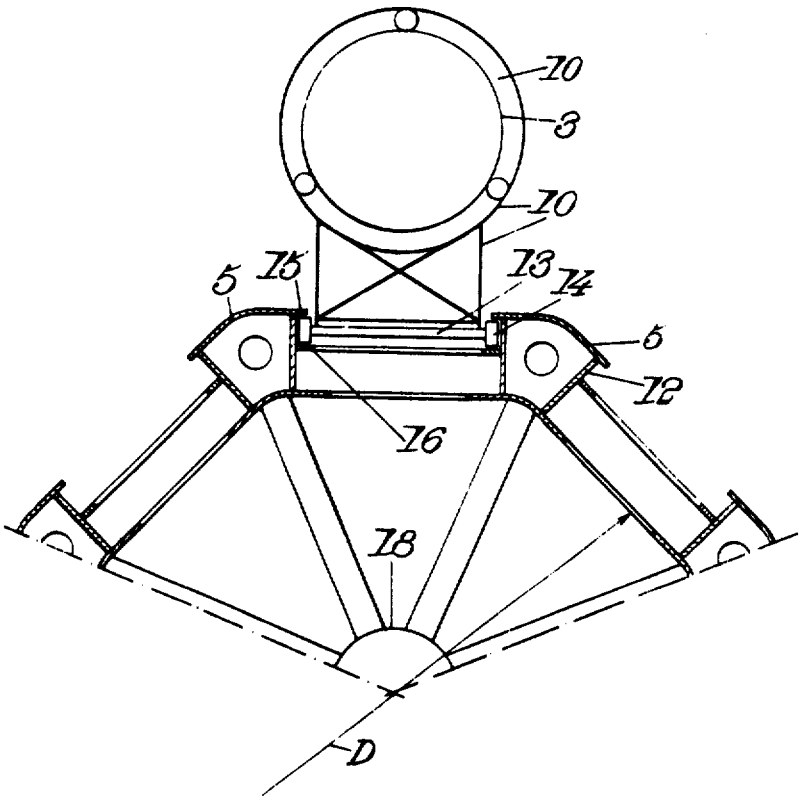
FIG. 3 shows separately, in semi cross-section, one of the vertical members or piles of said column.

In the drawings it has been supposed that members 5 were eight in number (as shown in FIG. 3), thus defining, in combination with appropriate spacers 11 a certain number of sides along which or at least along certain of which trolleys or similar can be vertically guided, themselves arranged so that the well-heads 3, or other load which they may be called on to support, is located over the respective wells.

In the embodiment shown, corresponding for example to a column height of about 100 to 150 m., the inner space D (FIG. 3) of the column is about 10 m. whereas the thickness of the section of the tubular shaped posts is about 1 m. It is then easy to provide in the section of these posts means for guiding said trolleys 10.

These guide means are constituted in the embodiment shown by clearances 12 arranged in the spaces separating the posts, these clearances allowing the movement of travelling frames 13 integral with said trolleys, the wheels 14 of these frames being able to rotate while being guided by the rail-forming flanges such as 15, 16 integral with the posts (FIG. 3).

The column is of course fitted with at least one principal float 17 (FIG. 2), which provides a vertical thrust for keeping said column substantially vertical, this float as well as other auxiliary floats being enclosed inside the space defined by the posts so as not to hinder the guiding of said trolleys. It comprises also at its centre a vertical shaft 18 serving as an elevator shaft for a diving capsule for periodic inspections and maintenance by divers.

In the upper part, an overhead crane 19 is provided on deck 6 forming a helideck, with handling appliances 20 for taking packets from boats tying up at the column.

Living accomodation 21 is provided under the helideck. The two platforms 7 and 8 are themselves equipped with all handling equipment and comprise power sources.

With such an assembly it can be easily understood that well-heads or other appliances (valve controls or tools) can be assembled or disassembled by removably fixing them to trolleys 10 and by manoeuvring them with block and tackle or other lifting appliances 22 (FIG. 1).

If it is a question for example of lowering a well-head 3, it is fixed by removable locking means to a trolley 10 running on the corresponding face of the column by means of the travelling frame 13, and it is progressively lowered towards the corresponding well 1 by means of block and tackle 22.

Figure 2:
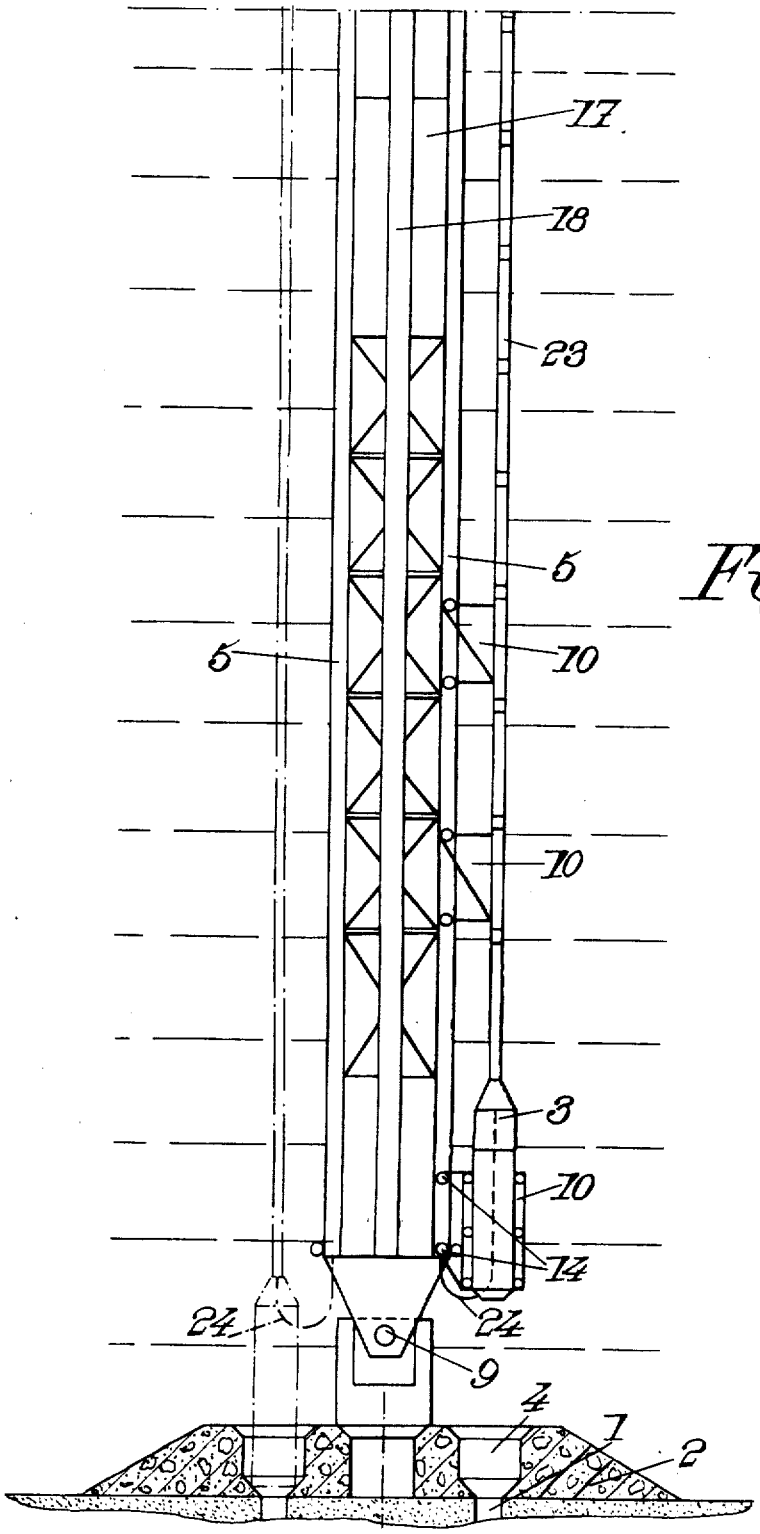
FIG. 2 shows on a smaller scale the lower part of this column, hinged to a base at which end several wells, the whole in accordance with the invention.

As the lowering progresses a train of hollow rods 23 is lowered, as usual, for cooperation with head 3. These rods are formed for example by lengths of tube 10 m. long which are superposed and assembled as the lowering progresses and which are also guided by means of other trolleys 10 such as shown in FIG. 2.

Once the trolley 10 carrying head 3 has arrived at the lower part of a column, it comes to a standstill against a stop. The head is then unlocked, possibly automatically owing to the action of said stop, so as to be able to continue its descent and penetrate into opening 4 of the corresponding well 1 where it is fixed by any means of known type.

The same operations are provided for the removal of a head and its raising to the platform.

Each well-head is associated, conventionally, with a remote control cable 24 FIGS. 4 to 9) which, according to another arrangement of the invention, is passed inside one of the adjacent posts 5, in its path between the control cabinet 25 (FIG. 6) and the well-head 3, which ensures that the cable is well protected.

Furthermore means will be advantageously provided for lowering or raising said cable by means of a rope 26 (or any other appropriate means), in relation to the operations for putting head 3 in place or for raising it.

Thus, with a remote control cable 24 and a rope 26 both capable of being wound on respective winches 27 and 28 or of being unwound therefrom, the procedure is as follows.

Figure 4:
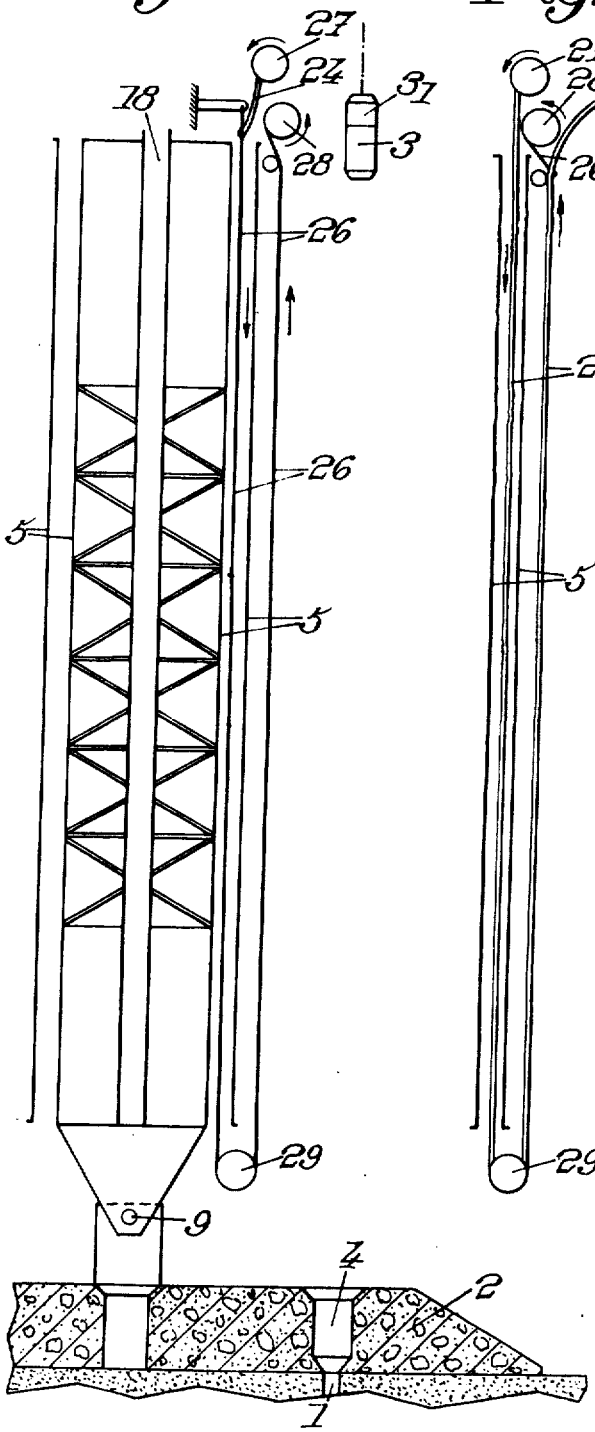
FIG. 4 illustrates schematically in elevation, partly in section, the whole of the column and a rope for lowering and raising operations of a remote control cable to be connected to a well-head.

First of all for the operation of putting a head 3, for example, into place, rope 26 is used which leaving its winch 28 extends on the outside downwards as far as a pulley 29 mounted at the base of the column and then passes inside the adjacent hollow post 5 to meet the remote control cable 24 leaving its winch 27 (FIG. 4).

Figure 5:
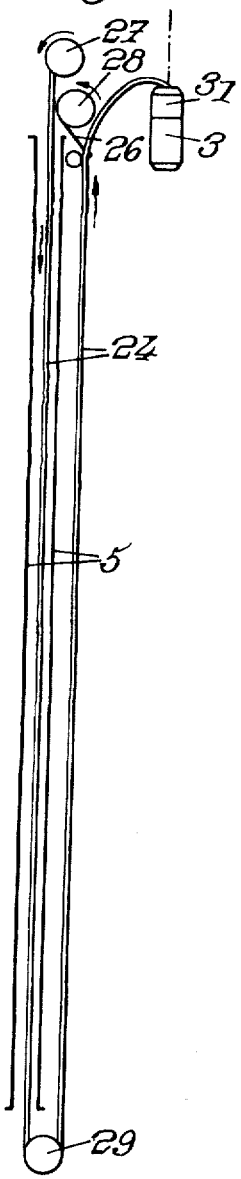
FIGS. 5 and 6 illustrate similarly the same unit (a single post of the column being shown), during two successive phases relative to the lowering of a well-head with its cable.
Figure 6:
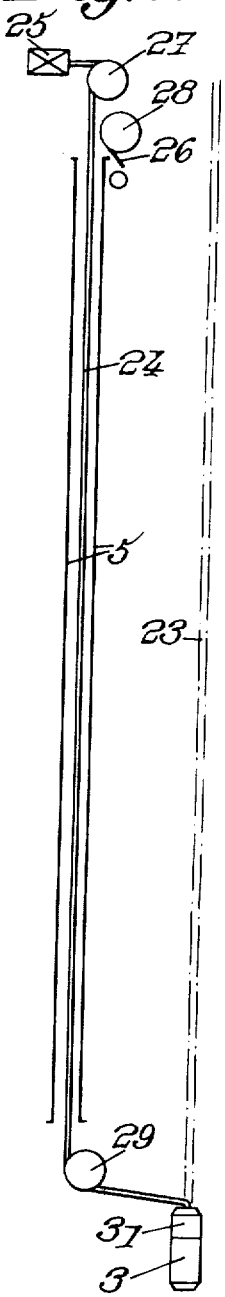

By then actuating in suitable directions the two winches 27 and 28, cable 24 is drawn inside post 5 and then comes up again towards head 3 located at the top of the platform. The connections between cable 24 and head 3 are made and then rope 26 is released (FIG. 5).

It remains then to lower the head with its cable, the other end of which comes up again through post 5, by actuating winch 27. When everything is finished, cable 24 is connected to the remote control cabinet 25 by any appropriate connector means.

Figure 7:
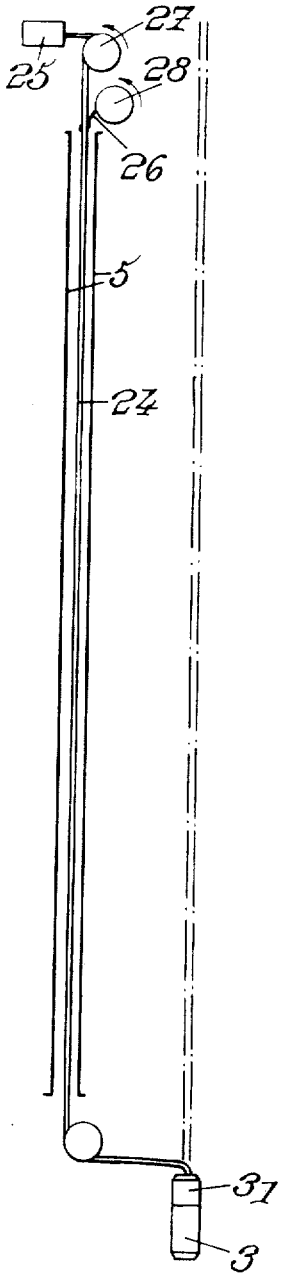
FIG. 7 shows similarly the beginning of a cable raising operation and at least the upper part of the well-head.
Figure 8:
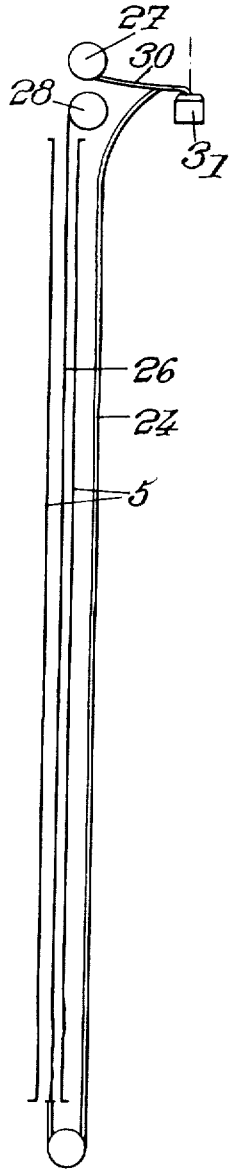
FIGS. 8 and 9 illustrate two successive phases of this raising.
Figure 9:
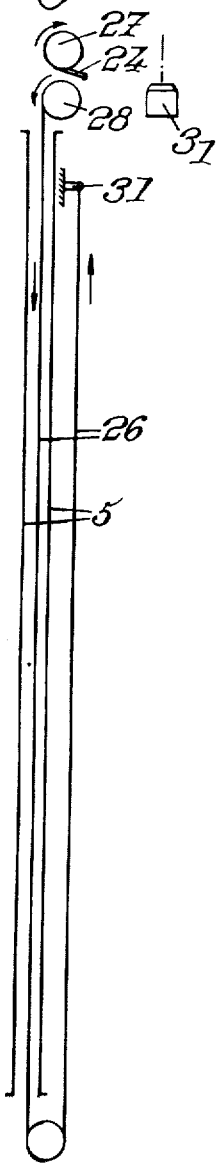

For the reverse operation, i.e. the raising of the well-head for maintenance or other operations, or at least the raising of the upper removable part $3_1$ (FIGS. 7-9) of this head, the procedure is reversed as clearly shown on FIGS. 7 to 9.

In FIG. 7 rope 26 is again secured to cable 24 and the winches operated to bring up again the assembly of cable and head 3 or $3_1$ (FIG. 8), cabinet 25 being disconnected. When the head has arrived at the platform (FIG. 8), there still remains a length of cable 24 which must be brought up again. For this purpose the length of cable leaving winch 27 at 30 is connected to the main length and, the whole being unfastened from head $3_1$, winch 27 winds up completely cable 24. At the same time winch 28 has of course unwound rope 26 which comes up again inside post 5 to be secured temporarily at 31 (FIG. 9).

Any other operating method could be adopted.

In any case it can be seen that the to and fro operations of the remote control cable can take place without the need for divers.

Following which, whatever the embodiment adopted, service columns can be constructed whose operation is sufficiently clear from the preceding for it to be pointless to dwell further thereon and which present, with respect to units of the kind in question already existing, numerous advantages, particularly:

that of enabling the maintenance and the supervision of well-heads and all members cooperating therewith to be easily provided, that of enabling servicing and maintenance operations to be carried out irrespective of meteorological conditions, that of providing a good protection for the remote control cables, and that of enabling them to be handled without the need for operators at the bottom.

As is obvious, and as it results moreover already from what has gone before, the invention is in no wise limited to those of its modes of application and embodiments which have been more especially contemplated; it covers on the contrary all variations.

I claim:

1. Column structure for handling appliances on the seabed, particularly for the assembly and maintenance of well-heads, or other devices intended to cooperate with the orifices of wells in the seabed, said column being coupled to a base constructed on the seabed over a certain number of drilling wells and comprising a lower part coupled to said base, a body part formed essentially by a plurality of elongated vertical members, and an upper structure forming at least one platform, trolleys movable between said upper structure and said lower part of said body part and adapted for carrying well-heads or other devices between said upper structure and said base and for releasing same upon reaching said lower part at a position above corresponding well orifices, said elongate vertical members forming said body part having lateral walls constituting guide rails for said trolleys, and said trolleys being movably disposed on said guide rails for guided movement therealong.

2. Column structure as claimed in claim 1 wherein said column is coupled to said base by an articulated coupling.

3. A column according to claim 2, wherein the trolleys are arranged so that well-heads carried thereby can, in the lower position of said trolleys, come just over the respective orifices of said wells.

4. A column according to claim 2, wherein said elongate vertical members include clearances against which are guided roller means integral with the trolleys.

5. A column according to claim 2, wherein the elongate vertical members are hollow and carry remote control cables for the well-heads.

6. A column according to claim 2, wherein the attachment between each well-head and its trolley is removable and means are provided for unlocking the head on the descent when the trolley reaches its lower position against a stop opposite the corresponding well orifice, so that it can continue its descent as far as its normal securing position at the entrance of the well.

7. A column according to claim 2, wherein it comprises, for the handling of each of the remote control cables of the well-heads, on the one hand, a first winch from which such a cable can unwind and, on the other, a second winch from which a rope can unwind for attachment to one end of the cable, the actuation of said winches causing, according to the direction in which they are driven, the descent or the raising of the cable by passing preferably inside the corresponding hollow elongated vertical member, and the whole in combination with a remote control cabinet to which the cable can be connected or disconnected at will.

* * * * *